US008475736B2

(12) United States Patent
Wimberger-Friedl et al.

(10) Patent No.: US 8,475,736 B2
(45) Date of Patent: Jul. 2, 2013

(54) MICROFLUIDIC DEVICE AND METHOD OF MANUFACTURING THE SAME AND SENSOR INCORPORATING THE SAME

(75) Inventors: Reinhold Wimberger-Friedl, Eindhoven (NL); Roel Penterman, Eindhoven (NL); Ralph Kurt, Eindhoven (NL); Emiel Peeters, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 301 days.

(21) Appl. No.: 12/746,940

(22) PCT Filed: Dec. 8, 2008

(86) PCT No.: PCT/IB2008/055142

§ 371 (c)(1), (2), (4) Date: Jun. 9, 2010

(87) PCT Pub. No.: WO2009/077913

PCT Pub. Date: Jun. 25, 2009

(65) Prior Publication Data

US 2010/0266450 A1 Oct. 21, 2010

(30) Foreign Application Priority Data

Dec. 14, 2007 (EP) ..... 07123253

(51) Int. Cl.
*B01L 3/00* (2006.01)

(52) U.S. Cl.
USPC ..... 422/502

(58) Field of Classification Search
USPC ..... 422/502
See application file for complete search history.

(56) References Cited

U.S. PATENT DOCUMENTS

| | | | | |
|---|---|---|---|---|
| 5,641,400 | A * | 6/1997 | Kaltenbach et al. | 210/198.2 |
| 7,223,364 | B1 | 5/2007 | Johnston et al. | |
| 2003/0118481 | A1 | 6/2003 | Briscoe et al. | |
| 2004/0053422 | A1 | 3/2004 | Chan et al. | |

FOREIGN PATENT DOCUMENTS

| | | | |
|---|---|---|---|
| EP | 0770871 | A2 | 5/1997 |
| EP | 1584692 | A2 | 10/2005 |
| WO | 2007060580 | A1 | 5/2007 |

* cited by examiner

*Primary Examiner* — Lore Jarrett

(57) ABSTRACT

The present invention provides a microfluidic device, for instance for molecular sieving or for detecting a target substance in a sample fluid. The device comprises a first substrate (120) having a substantially flat first surface that is provided with first recesses (124), and a second substrate (128) having a substantially flat second surface that is provided with second recesses (130). At least some of the first recesses are filled with a porous material (114). Alternate first recesses and second recesses form a meandering channel for a sample fluid. The second recesses may be filled with a further porous material. In an embodiment, a capture substance for binding a target substance is arranged in or on the porous material.

15 Claims, 8 Drawing Sheets

MICROFLUIDIC DEVICE AND METHOD OF MANUFACTURING THE SAME AND SENSOR INCORPORATING THE SAME

FIELD OF THE INVENTION

The present invention relates to a microfluidic device. The device may be part of, or is for instance a biosensor or a device for detecting a target substance in a sample fluid.

Applications include molecular diagnostic biosensors, DNA arrays, drug, environmental, and food quality sensors. The disclosed device could be applied for separation of substances (chromatography), for instance for DNA sequencing, extracting DNA or protein from a sample, and molecular sieving.

BACKGROUND OF THE INVENTION

In fields such as molecular diagnostics, biosensors are used to test or analyze a sample fluid, such as blood or another body fluid on the presence of one or more target substances. Such target substances include for example an antigen, a microorganism and/or molecules. To this end, in one type of biosensor, the target substance is bound or captured by a capture substance that is immobilized on a surface within a microfluidic device. The immobilization areas may be called spots. The microfluidic device typically is used for its capability of handling small amounts of sample fluid which are often scarcely available. The presence of the target substance is made tangible via the attachment of a label, such as a fluorescent molecule or any other label which creates a physical effect that can be detected. Optical labels are most commonly used. In order to allow multiplexed sensing, i.e. the sensing of multiple target substances sequentially or simultaneously within a sample fluid with one biosensor, the microfluidic device may comprise multiple capture substances immobilized within one or more spots, either or not organized within an array, at one of its surfaces.

Two arrangements of biosensor devices have been proposed and are used in practice, i.e. a so-called flow-over concept and a so-called flow-through concept.

A biosensor according to the flow-through concept uses a porous membrane having average pore sizes smaller than one micrometer. The spots comprising the capture substances are present on the membranes. By forcing the sample fluid through the membrane, the diffusion distances become very small for the biological molecules comprised in the sample fluid, so that diffusive transport will not limit the adsorption kinetics and efficient capturing of target substance is accomplished.

WO-2007/060580-A1 discloses a microfluidic device comprising a porous membrane enclosed by two housing parts. The membrane is provided with spots of immobilized capture substances for binding target substances. The two housing parts comprise a number of recesses. Together, the recesses of the two housing parts form a channel for guiding a sample fluid. The spots are provided at one or more of the positions where the channel intersects the membrane. The sample fluid that is guided through a particular channel passes each membrane of that channel.

SUMMARY OF THE INVENTION

It is an object of the invention to provide an improved microfluidic device and sensor device that incorporates the microfluidic device.

The invention is defined by the independent claims. The dependent claims define advantageous embodiments.

The microfluidic device of the invention combines a number of features such that it requires small sample volume, while reducing or mitigating sample fluid leakage from the porous material within one recess to porous material in another recess through a path that is not part of the channel. For example in the device of WO-2007/060580-A1 sample fluid may leak via the membrane itself in this way, i.e. sample fluid may be transported through the porous membrane that is interposed between the two housing parts in a direction other than the direction of the channel, i.e. in the plane of the porous membrane. The average pore size of the membrane in that device is therefore restricted to such dimensions that leakage of the sample fluid is limited to an acceptable level.

The design of the microfluidic device of the present invention is such that the membranes are not interconnected since in the channel direction there is no membrane material in between successive membranes. Hence, the leakage of the prior art devices is prevented altogether and the device of the present invention provides a wider field of applicability.

Furthermore, the design of the microfluidic device of the invention integrates the porous material within (part of) the recesses such that the walls of the recesses support and protect the porous material from destruction during use. The device therewith is more robust and reliable and provides more robust reliable functioning.

Preferably, the recesses are substantially completely filled. Thus a recess is for instance filled depending on the accuracy of the respective technology that is used to arrange the porous material in the recesses. Substantially completely filled indicates for instance that at least a cross section of the channel, i.e. a cross section of the recesses, is more than 80%, preferably more than 90%, most preferably more than 95% filled with said porous material. Not all recesses need to be filled with porous material. Along the channel, at least one or a plurality of recesses is filled. Preferably a recess is filled such that the porous material contacts at least one surface of the recess that is not parallel to the main flow direction within a channel, i.e. abuts a corner of the cannel, such that it is located in a corner of the recess. Abutting or contacting in this case means attached to or just in physical contact. In that case the porous material is supported by the channel wall in the flow direction within the channel. Alternatively, or additionally, the porous material may be arranged such that its dimension along the length direction of the channel (parallel to the main flow direction) within the channel is larger than at least one of its dimensions in the cross sectional direction of the channel. These locations in the corner and/or geometries of the porous material within the channel offer increased robustness to the porous material so that it may now withstand larger pressure and or flow speed enabling increased speed of operation of the microfluidic device and or the sensor that makes use of the microfluidic device. In addition, more viscous samples may be mumped through the channel. Alternatively, the open porosity (as defined hereinafter) of the porous material may be increased without reducing the robustness of the membrane. For example this allows reduction of pressures to be used within the device for inducing flow and/or allows the use of more viscous samples without having to use increased pressures for inducing flow.

Thus, in general, since the sections of porous material are enclosed in a cavity of solid material, the mechanical loading of the porous material is reduced and the porous material can be brittle and very open. Brittle and very open herein indicates that the porous material has a relatively low solid fraction. This invention enables the use of very thin membranes of brittle porous material.

US-2004/0053422-A1 discloses microfluidic devices having porous membranes for molecular sieving, metering and separation of analyte fluids. In one aspect, the device includes a substrate having input and output sections separated by a porous membrane formed integral to the substrate. In another aspect, the device includes a cascading series of upper and lower channels, wherein each upper/lower channel interface is separated by a respective porous membrane.

The porous membranes comprised in the devices of US-2004/0053422-A1 are arranged in the channel, perpendicular to the direction of the sample fluid flow. In contrast to that of the invention, this prior art arrangement lacks the increased resistance to withstand the force of the sample fluid flow beyond a certain range as explained here above.

Furthermore, it is relatively difficult to fabricate a device comprising several free standing porous membranes such as that of US-2004/0053422-A1, each membrane having a thickness in the range of 100 micrometer to a few millimeter, will be vulnerable during manufacturing. Free standing herein indicates membranes that are arranged in the channel perpendicular to the sample fluid flow, wherein membrane edges are fixated in the channel walls. The device according to the invention does not require such free standing membranes and reduces the vulnerability of the device therewith increasing the manufacturing yield.

According to a preferred embodiment the porous material has an open porosity greater than 25% and smaller than 80%, preferred between 35% and 70%, most preferred between 45% and 60%. The term "open porosity of X %" herein means that X % of the volume of the porous material is empty. The pores of the material are connected to each other and to the outer surface of the material. The term "open porosity" indicates the fraction of the total volume of the porous material wherein fluid flow is effectively taking place.

In another embodiment, the average pore size of the porous material is for instance between 10 nm and 10 μm, preferably between 20 nm and 2 μm, more preferably between 25 nm and 1 μm, and most preferably between 50 nm and 500 nm. The pore size distribution is preferably very small. FWHM is for instance smaller than a factor 2 of the average pore size.

In an embodiment, the porous material includes an isotropic polymeric material.

The disclosed substrate technology allows the use of a broader range of materials as well as thinner porous structures in combination with an improved mechanical strength and ruggedness. The latter allows easier handling, for instance during application of spots of biomolecular capture probes. The device of the present invention allows higher pressures and flow speeds of the sample fluid during use.

In an embodiment, the first and second recesses are located in different substrates. This is advantageous with respect to the manufacture of the micro fluidic device in terms of complexity. Both substrates may be processed independently and interference between process steps is reduced or even absent. For example when the first recesses need to have different capture probes than second recesses. Hence, apart from cost reduction, this will enable simple mass production to provide disposable microfluidic devices.

In an embodiment, at least some of the second recesses are filled with a further porous material. Preferably, a further capture substance for binding a target substance is arranged in or on the further porous material of at least some of the second recesses. The further porous material may include the same material as the first porous material, and/or other porous materials. The construction of the device of the present invention renders any combination of porous materials conceivable.

In an embodiment, a capture substance for binding a target substance is arranged in or on the porous material of one or more of the first recesses, and/or a further capture substance for binding a target substance is arranged in or on the further porous material of one or more of the second recesses. Each spot comprising capture substance preferably contacts the surface of the opposing substrate. Contact between the capture substance and the substrate surface improves coupling, and improves the signal-to-noise ratio in for instance the case of light output detection. The capture substance is for instance comprised in the class of luminescent substances such as for example fluorescent or phosphorescent substances.

The device combines two substrates, both having alternating areas of porous material and solid material. The meandering channel alternately follows one of the first recesses and continues in one of the second recesses, and so on. Having alternating solid and porous areas has advantages over a straight channel that is provided with walls of porous materials. The capture probes or spots can be printed closer together since mixing of different capture probes is prevented. Furthermore, the flow of the sample fluid is directed to the positions of the respective capture probes, i.e. the spots. This leads to a better screening of the solution and to an increased binding rate of the target substance(s).

In another embodiment, walls are provided at the interface of the first substrate and the second substrate for guiding a first measuring signal of the capture substance in a first direction, and/or for guiding a second measuring signal of the further capture substance in a second direction. Preferably, the second direction is substantially opposite to the first direction. The opposed directions of the measuring signals improves light out coupling and reduces signal-to-noise ratio. By integrating porous material and spots in both substrates, the spot density can be doubled with the same flow channel design.

In an embodiment, the first porous material contacts the second surface of the second substrate. In another embodiment, the second porous material contacts the first surface of the first substrate. Thus the porous material completely fills the channel height and prevents sample fluid passing the porous material instead of going through the porous material.

The disclosed design allows improved optical performance of the device as the spot comprising fluorescent capture substance may be well defined, i.e. reliable and reproducible, due to the construction of the substrate. The device of the present invention obviates relying on the undefined rim of the printed fluid with capture probes in the porous structure.

In another embodiment, the porous material is capable of swelling in contact with a sample fluid. If there would be some space between the substrate surface and the spot embedded in the porous material, a portion of the sample fluid would be able to pass the spot without interacting, which would lead to lower sensing signals. A porous material which is capable to swell closes such space and prevents the sample fluid from passing the spot without interacting. During use, the sample fluid will make the porous material swell. The material will press the spot that is embedded therein against the surface of the opposing substrate, thus improving the contact of the opposing substrate surface and the respective spot.

In an embodiment, quencher substances are included in the porous material. Alternatively, the bottom of the first recesses and/or of the second recesses is provided with an absorbing or reflecting layer. The quencher substances and the absorbing or reflecting layer reduce the luminescence background noise, such as that stemming for example from background fluorescence.

In an embodiment, the first recesses and/or the second recesses have tapered or beveled walls. The tapered or beveled walls collimate the light outputted by the capture substances of the spots.

In another embodiment, the side walls of the first recesses and/or of the second recesses are provided with a reflecting layer. The reflecting layers guide the light that is outputted by the capture substances of the spots, for improving the light output and the signal-to-noise ratio.

In an embodiment, the first substrate and/or the second substrate is substantially transparent. The transparent first or second substrate is preferably translucent for radiation having a wavelength within the range of 350 nm to 1000 nm. The range may include that of visible light. Transparent substrates enable detection of target substances using luminescence such as for example fluorescence and or phosphorescence.

According to another aspect there is provided a sensor device incorporating the micro fluidic device and a detector. The detector serves to detect or sense signals generated by target molecules that have been captured by the capture substances immobilized on the microfluidic device. In one embodiment, the porous material may be used to just perform filtering functions before detection at other sites. In another embodiment the capture probes may be provided to the porous material of the channels of the microfluidic device.

The sensor device benefits from the advantages of the micro fluidic device with respect to increased flow speed or obtainable pressure within the channel translating to amongst others increased sensing speed, sensing sensitivity, increased robustness and/or increased reliability during use and/or manufacture. The microfluidic device may be part of the sensor device in a permanent arrangement, i.e. it may form an integral part of the sensor device. In this case the sensor device also benefits from advantages provided by the manufacturing of the microfluidic device. Alternatively, the micro fluidic device may be removable from the sensor device. In the latter case the sample fluid may be provided to the microfluidic device such that the device performs its functions of filtering and/or capturing of target substances before being inserted into the sensor device in order to perform the analysis of the treated sample fluid.

The sensor device may be a biosensor device. The device of the invention will be particularly useful in the biomolecular field of technology as fluids to be analyzed in this area, such as bodily fluids or preps of such fluids, will be scarcely available and generally in small quantities. Furthermore, the application of the devices according to the invention in this area of technology including medical diagnostics and environmental pollution or food poisoning require the relevant target substances to be determined as reliably and reproducibly as possible at often very low concentrations within the fluids. Furthermore, often a large number of different target substances or molecules have to be determined simultaneously in this way.

The sensitivity is determined by the efficiency of immobilizing the target substances and by the sensitivity of the sensor principle. The efficiency of immobilizing the target substances depends on the concentration of the target substances, their diffusion and reaction kinetics, the surface area of the capture substances and the accessibility thereof. The sensitivity of the sensor principle is mainly determined by the signal background (including all sorts of noise) and, in the case of optical detection, the efficiency of photon collection.

The binding rate of target substances or molecules at very low concentrations in the sample fluid is limited by diffusion to the sensor substrate. The binding rate is limited even more for molecules with a higher molecular weight. The invention provides the improved flow characteristics that lead to increased sensitivity and reliability.

According to another aspect, the present invention provides a method of manufacturing a microfluidic device.

A low cost roll-to-roll manufacturing method, comparable to for instance CD and DVD manufacturing, can be used to manufacture the substrates of the present invention. Thus, production costs may be low to allow economically viable production of disposable devices.

The microfluidic device of the invention is advantageous with respect to prior art devices having lateral flow-over or multiple parallel arranged flow-through membranes. This is due to the fact that by pumping the sample fluid through the membrane or membranes of such a prior art device, all spots comprising capture substances are exposed simultaneously. However, since every spot screens only a very limited portion of the sample fluid volume (typically less than 1% or even less), depletion of the solution limits the achievable measurement sensitivity. The fluidic arrangement for the flow-through system may also limit the accessibility of probe areas for optical components, which are required for luminescence detection. Furthermore, inhomogeneities in the membrane permeability can lead to strong variations in effective screened sample fluid volume per spot. Although in such cases the homogeneity may be improved by circulating the sample fluid and or reversing of flow after every passage of the membrane this requires operation time that is costly. In addition an increased sample fluid volume is required as well as additional mixing provisions to guarantee homogenous and efficient mixing. Mixing in microfluidic channels is particularly difficult as the flow of sample fluid is substantially laminar due to low Reynolds numbers. The sample fluid has to be repeatedly circulated to significantly improve the screening of target substances. However, repeated circulation of sample fluid is too impractical to screen substantially 100% of all target substances. All these drawbacks may be reduced or prevented by the microfluidic device of the present invention.

BRIEF DESCRIPTION OF THE DRAWINGS

Further features and advantages of the invention will appear from the enclosed drawings, wherein.

DETAILED DESCRIPTION OF EMBODIMENTS

Figure 1:
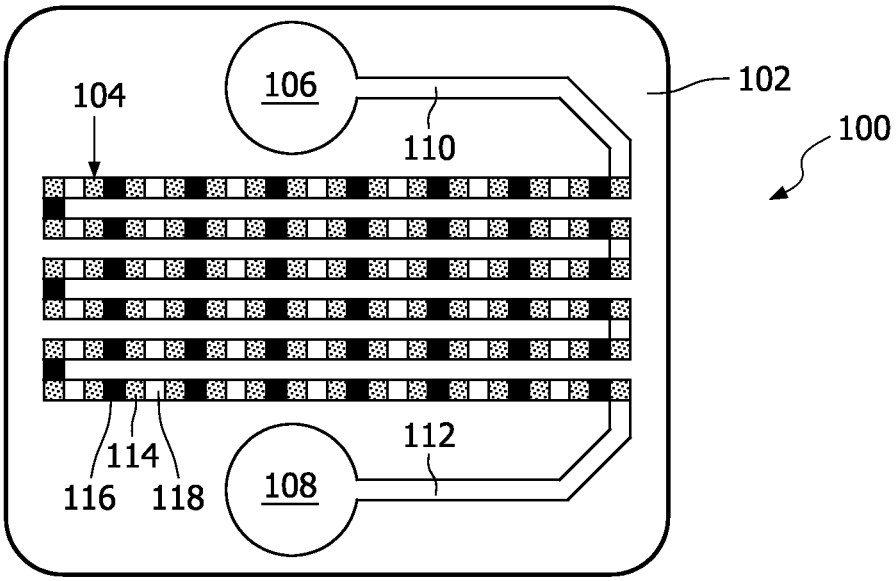
FIG. 1 shows a plan view of an embodiment of the microfluidic device according to the invention.

FIG. 1 shows a microfluidic device 100 according to an embodiment of the present invention. The device comprises a two-layer laminate enclosing a channel 104 for guiding sample fluid from an inlet 106 to an outlet 108. The inlet 106 and outlet 108 have a larger cross section than the channel to allow easier connection of external fluid containers (not shown). The channel 104 comprises: inlet channel part 110 and outlet channel part 112, porous material areas 114 and empty areas 118 in between the porous material areas 114. The inlet channel part 110 and the outlet channel part 112, as well as the empty areas 118 provide an open passage for gaseous or liquid samples through the channel.

Figure 2:
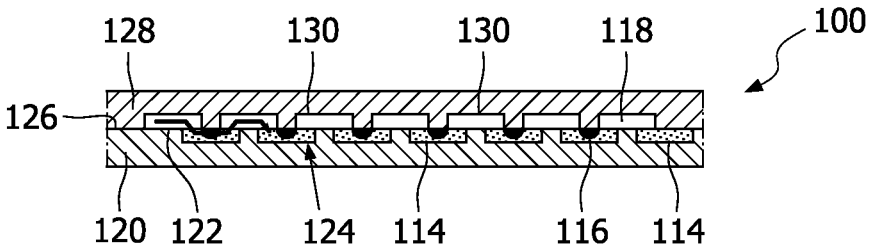
FIG. 2 shows a sectional view of the embodiment of FIG. 1.

The two-layer laminate structure of the microfluidic device 100 is further elucidated in the cross sectional view of FIG. 2, wherein it is shown that the micro fluidic device 100 comprises a first substrate 120, having a substantially flat first surface 122, first recesses 124 and a second substrate 128 having a substantially flat surface 126 and having second recesses 130 therein. The second surface 126 contacts the first surface 122 such that the first and second substrates form the two-layer laminate. In the laminate an interface is formed between the first and second contact surfaces whereat the first and second recesses are located. Thus, the recesses in the substrates form a channel 104 that meanders in the cross sectional plane. The first and the second recesses are preferably shaped as elongated grooves, i.e. grooves that are relatively shallow, narrow and long. Details and examples of the recesses are described below with respect to FIGS. 7-9.

The channel 104 of the embodiment represented by FIG. 2 meanders across the contact surface of the two substrates since the first recesses are in the first substrate and the second recesses in the second substrate. In another embodiment, the entire channel is located within one of the substrates. In this other embodiment, the first recesses and second recesses are both located in the first substrate. The first and second recesses are located with respect to each other such that together they form a channel that meanders in the plane of the device, i.e. in a direction perpendicular to the cross sectional area. In this embodiment the second substrate does not need to have recesses formed therein in order to define channels in the device. The second substrate may have a substantially flat second surface such that it functions as a cover or lid when contacting the first surface of the first substrate.

According to the invention, at least some of the first recesses 124 are filled with the porous material 114. The presence of the porous material enables that the microfluidic device be used as a microfilter device, with a porous material within a recess forming one microfilter. Alternatively, the porous material may enable enlargement of effective surface area that is in contact with a gas or liquid sample flowing through a channel. Both purposes may also be served simultaneously or sequentially within one device.

Multiple variations of combinations of porous material within a device are possible in order to enable all sorts of filtering functions or increases of effective surface area. Thus, in one embodiment only the first recesses comprise porous material, such that, the continuous, uninterrupted meandering channel 104 comprises alternating porous and empty parts. Alternatively, in another embodiment, shown in FIGS. 3 and 4, the porous material 114 is integrated in both the first recesses 124 and the second recesses 130 so that a meandering continuous channel of porous material is formed.

Figure 3:
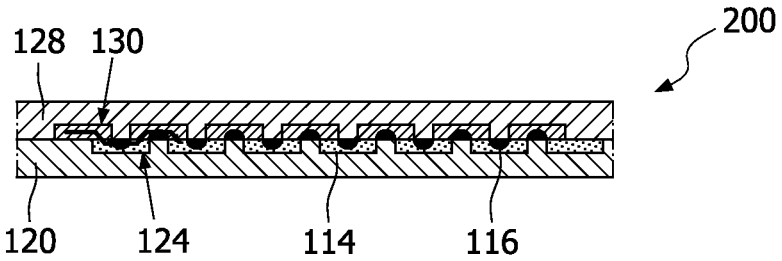
FIG. 3 shows a sectional view of another embodiment of the device of the invention.
Figure 4:
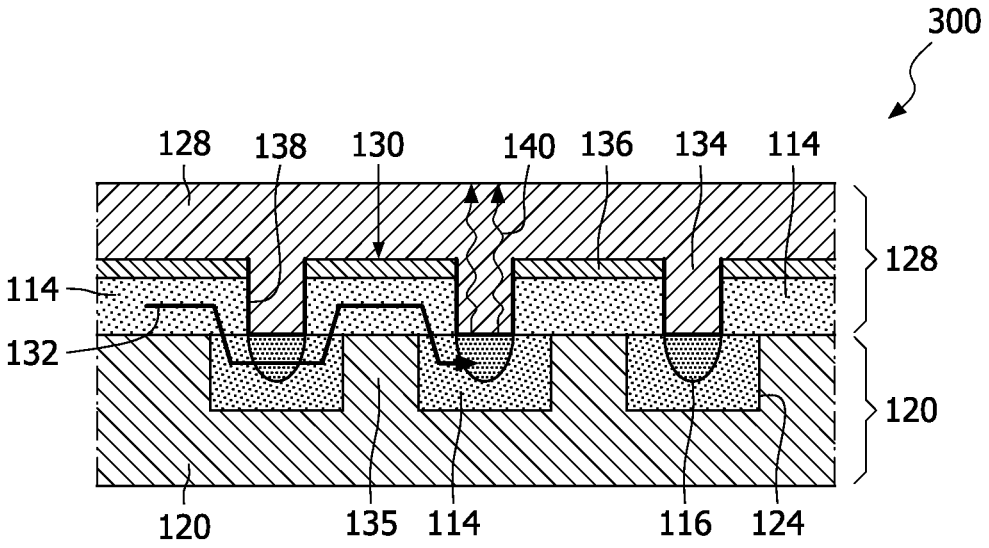
FIG. 4 shows a detailed sectional view of an embodiment of the device according to the invention.

In the device according to the invention, as exemplified by embodiments of FIGS. 2, 3 and 4, the first and second substrates are for instance glued, locally melted, or clamped together so that the first substrate 120 and the second substrate 128 directly contact each other. The porous material is disposed such that there is no membrane layer of porous material interposed between the contacting surfaces of substrates through which leakage of fluid can take place as is the case with prior art devices. Instead, porous sections are buried within the substrates so that the porous sections form an integral part of the structured substrate. Since the porous structures are separate and enclosed in a 'cavity' of solid material they are not exposed to significant mechanical loading and therefore can be brittle and very open (low solid fraction). The porous material may be located so as to be in contact with a cornering part of the channel providing improved sustaining of the porous material by the channel wall. The microfluidic device thus provides improved functioning and is more robust.

According to a preferred embodiment the porous material has an open porosity greater than 25% and smaller than 80%, preferred between 35% and 70%, most preferred between 45% and 60%. The term "open porosity of X %" herein means that X % of the volume of the porous material is empty. The pores of the material are connected to each other and to the outer surface of the material so that a channel from one recess to the next recesses through the porous material is enabled. The term "open porosity" indicates the fraction of the total volume of the porous material wherein fluid flow is effectively taking place.

In another embodiment, the average pore size of the porous material is for instance between 10 nm and 10 μm, preferably between 20 nm and 2 μm, more preferably between 25 nm and 1 μm, and most preferably between 50 nm and 500 nm. The pore size distribution is preferably very small. FWHM is for instance smaller than a factor 2 of the average pore size.

In an embodiment all porous material within a device of the invention may comprise the same porous material. For example, the porous material may serve the function of increasing the effective surface area in contact with a gas or liquid sample flowing through a channel within the device. In an alternatively embodiment, different recesses may have different porous materials and/or different porosity such that in the flow direction of a channel the pore size decreases. This has the advantage that when the microfluidic device is used as a microfilter for filtering particles, larger particles are less likely to clog the very fine filters (porous materials) having very fine porosity. In order to adjust the pressure necessary to induce flow of a particular sample through a porous material, the porosity may be adjusted. Thus when, for example, the average pore size of a porous material reduces from one recess to the next, porosity may be increased to compensate for the flow speed reduction that is caused by reducing pore size. An increase of pore size will often be accompanied by a reduction in strength of the porous material as less material is available per unit volume. Hence for such setups, the device of the present invention provides an advantageous increase in strength.

In an embodiment as exemplified by FIG. 1, the porous material 114 in at least some of the first recesses 124 is provided with the spots 116 comprising one or more capture substances. This allows filtering of target substances from the gaseous or liquid sample flowing through the channels if they can be captured by the capturing substances. In an alternative embodiment shown in FIGS. 3 and 4, also the second recesses are provided with porous material carrying spots of capture substances. Therewith the spot density is doubled with respect to the device shown in FIG. 1, which has the same flow channel design.

The capture substances may either be present in only a part of a recess, or the capture substances may be distributed over the whole volume of a recess. Also, the capture substances may be arranged at the bottom of the respective recess, as shown for example in FIG. 5.

According to the above features, the microfluidic device according to the invention may be used within a sensor device providing the sensor with a filtering function. However, additionally, or alternatively, the sensor device may be given a sensing feature using the invention. To this end, the spots, irrespective of where they are located in recesses with porous material, must be capable of providing a measurement signal when target molecules are captured by the capture substances within the spots. A measurement signal means any difference between a starting situation before capturing and a resulting situation after capturing that can be sensed by the sensor device. Thus, the starting situation may be one where a strong signal is measured which reduces after capturing or vice versa. For example, the capture substances in spots 116 emit radio-frequency radiation, such as optical radiation, if contacted by one or more target substances. The radiation may originate from chemical reaction within the spot, i.e. for example chemoluminescence. Alternatively, the radiation may be luminescence such as fluorescence or phosphorescence that is emitted upon excitation of the luminescent species; which is emitted during or after irradiation of the spot with excitation radiation. The luminescence may be irradiated by the chemical or physical complex of capture and target substance either or not in conjunction with a label or marker species, the latter for providing for example the luminescent property. Any process providing a signal after a target substance has contacted a capture substance, either with or without external stimulus, can be used in the process. The signal may also include a change of absorption or radiation, i.e. after capturing the absorption of specific irradiation decreases or increases. Such alterations are well known in the art. The contacting may include physical and/or chemical binding.

In an embodiment the porous material regions comprise optical quencher substances for example in the form of particles that are fixed to the porous material 114. During a possible sensing action, the quencher substances reduce optical background signals not stemming from the labels that are used to determine whether capturing of a target substance by a capturing substance within a spot has taken place.

In an embodiment shown in FIG. 4 the device 300 includes a first substrate 120 and a second substrate 128. The substrates comprise first recesses 124 and second recesses 130 respectively, which together form the meandering channel 104. Both recesses are filled with the porous material 114. In the middle of the porous material area 114 in the recesses 124 of the first substrate 120 the device comprises spots 116 wherein capture molecules are immobilized. The two substrates 120, 128 are sealed together, such that the sample fluid is forced to follow a path 132 wherein first recesses 124 and second recesses 130 alternate. Subsequent recesses are separated by walls or stamps 134, 135, which are solid material areas of the substrate. Although not required, in this embodiment the walls 134 contact the recesses and/or the capture substances in the spots 116. If optical labels or markers that are included in the spots 116 are excited, signal 140 will be out-coupled through the stamps 134 of the transparent second substrate 128. In this way, the walls 134 serve to collect and guide signals 140 that originate from the spots when the capture substances capture target substances. This enhances sensitivity and specificity during sensing.

In an embodiment, an additional absorbing or reflecting layer 136 is provided. This reflecting layer may serve the purpose of reducing unwanted optical background signals. Additionally a reflecting layer 138 is applied on the side walls of the recesses 130 for guiding the signals 140 emitted by the spots 116. The reflecting layers may have a different reflective index than the substrate material such that for example total internal reflection occurs. The reflecting layers may be made of metal such as aluminum or gold evaporated within the recesses before the porous material is provided. Guiding the signals 140 increases the measuring signal, reduces signal-to-noise ratio and improves light out-coupling.

The contact between the spot 116 and the so-called stamp 134 preferably is as good as possible, to improve coupling and guiding of the signals 140.

A further reflecting layer (not shown in FIG. 4) may be provided at the bottom of the recesses that have the spots in the porous material. This reflective layer may redirect irradiation in the direction in which signal 140 leaves the substrate therewith increasing the signal to be sensed.

In an embodiment, the recesses within substrate 128 of an embodiment as drawn in FIG. 4 may comprise spots in addition to the ones already present as for example shown in the embodiment of FIG. 4. In that case the walls 135 may contact the additional spots of the recesses in substrate 128. As explained with respect to FIG. 4, reflecting layers may be used to advantage for a signal originating from the further spots and which leaves the substrate 120 in the direction opposite to the signal 140. The reflecting layers provide a suitable measure for separating excitation radiation and/or signals generated by spots from the substrate 128 and those of substrate 120.

In an embodiment the porous material 114 is capable of swelling if contacted by the sample fluid. If there would be a small space between the spot 116 and the wall 134, a portion of sample fluid could pass the respective spot 116 without interacting with the capture substances of the spot, which would lead to a lower measuring signal intensity. When the porous material 114 is capable to swell, the porous material will close any opening between the spot 116 and the wall 134, thus preventing the sample fluid to pass without interacting with the capture substances. The sample fluid will force the porous material to swell. The expanded porous material will press against the surface of the opposing substrate, thus providing a good contact of the opposing substrate and the respective spot.

Figure 5:
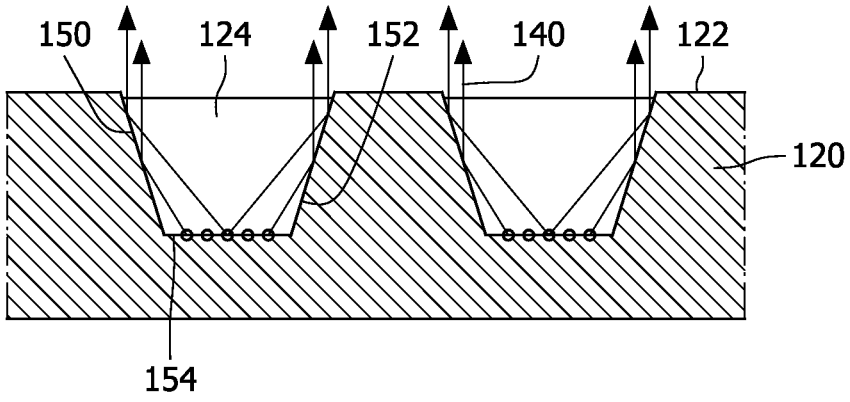
FIG. 5 shows a detailed sectional view of an embodiment of a substrate of the device of the invention, having recesses with tapered walls.

As shown in FIG. 5, side walls 150, 152 of the first and/or second recesses may be tapered or beveled, i.e., the side walls could be arranged at an angle of less than 90 degrees with respect to the bottom of the recess. The angle with respect to the recess bottom, or to the substrate surface, is for instance smaller than about 75 or 70 degrees. The side walls 150, 152 shown in FIG. 5 may be tapered in a length direction of the recess 124, and/or in a width direction. The bottom 154 and/or the tapered side walls reflect and collimate the (fluorescent) radiation signal 140 emitted by the spots.

The first and/or the second substrate may be transparent for the wavelength of the signal 140 used for detection of the capturing event.

In the microfluidic device according to the invention, having alternating areas of solid 134, 135 and porous 114 material within one substrate has advantages. Firstly, different capture probes can be printed closer to each other since mixing of the different capture probes is prevented by the solid boundary. Secondly, coupling the signal to the substrate can be improved using amongst others the above mentioned reflecting layers and/or recess structure or shape. This improves signal-to-noise ratio. But most importantly, the flow of the sample fluid is directed to the capture probes, thus leakage through an otherwise porous part 134 and/or 135 is prevented providing improved screening of the sample fluid and consequently increased binding speed of the target substances to the capture substances.

In another embodiment the refractive index of the first or second porous material is matched to the refractive index of the sample fluid to avoid light scattering. Avoiding light scattering improves the sensitivity of target substance detection.

In a practical embodiment, the substrates comprise an array of for example about 120 recesses. Other amounts of recesses may be used depending on need and design. The substrates will comprise about 120 spots. Each spot has a diameter of about 200 μm. The spots and/or the recesses are arranged with a pitch of about 400 μm. The inlet and outlet channels 110, 112 are defined in substantially the same way as the flow channel 104.

The inlet and outlet channel parts 110, 112 are intended as an example for a convenient interconnection for testing the device of the present invention. In a practical application, the input and output channel parts may for instance be integrated in a cartridge (not shown). The cartridge may provide other functionality, for instance regarding sample preparation, DNA extraction and amplification.

The devices described hereinbefore can be manufactured using a method according to the invention. FIGS. 6A to 6D illustrate results after subsequent steps of the a method.

Figure 6A:
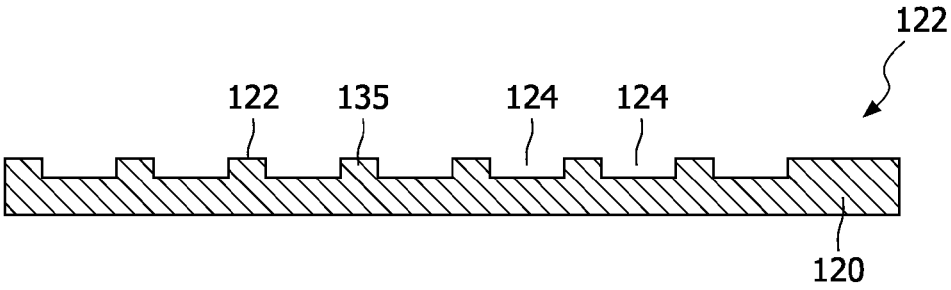
FIGS. 6A-6D show exemplary fabricating steps for fabricating a substrate of the device of the invention.
Figure 6B:
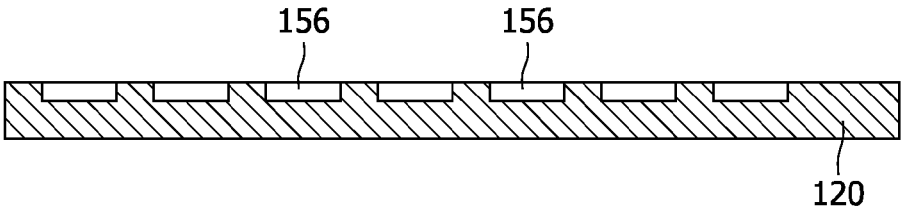

First, the recesses 124 are arranged in the surface 122 of the solid substrate 120 (FIG. 6A). The recesses are for instance micro structured by replication or embossing of a structure from a mold into a deformable (and/or reactive) material. Such processes include for instance injection molding and hot embossing. The processes can machine thin flexible substrates as well as thicker, stiffer substrates, like a CD or DVD medium. Alternatively, etching techniques are used. Especially when diameters are so small that the embossing or replication techniques are no longer advantageous.

The structured substrate 120 comprising the recesses 124 is then covered by a second material 156 (FIG. 6B), for instance a polymer solution or a mixture comprising a so-called non-solvent, which is a solvent that does not dissolve the material of the substrate 122. Excess material 156 is removed so that only the recessed regions 124 are filled with the material.

Figure 6C:
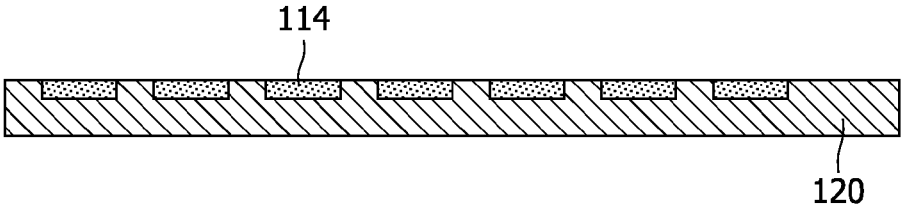
Figure 6D:
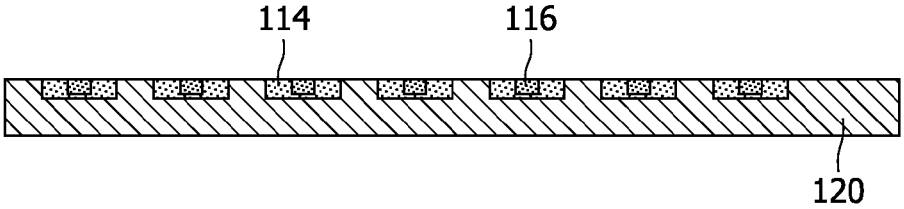
Figure 16:
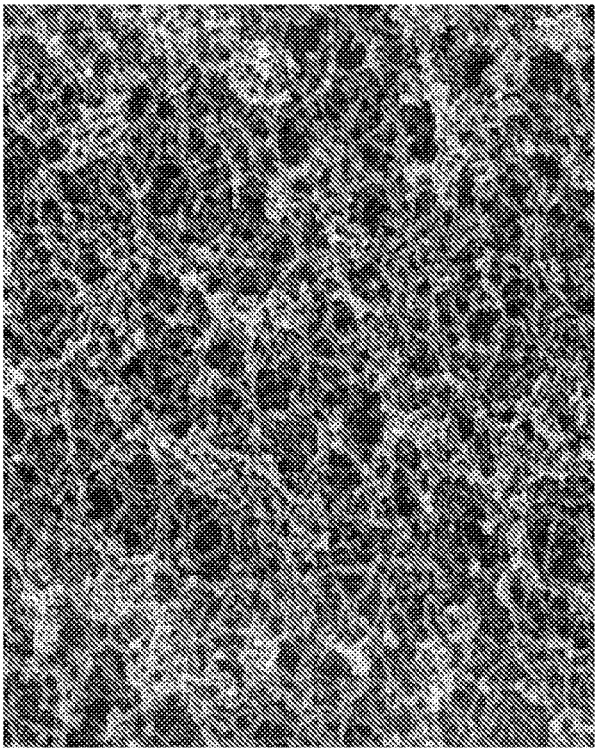
FIG. 16 shows a SEM micrograph of porous material suitable for the device of the invention.
Figure 15:
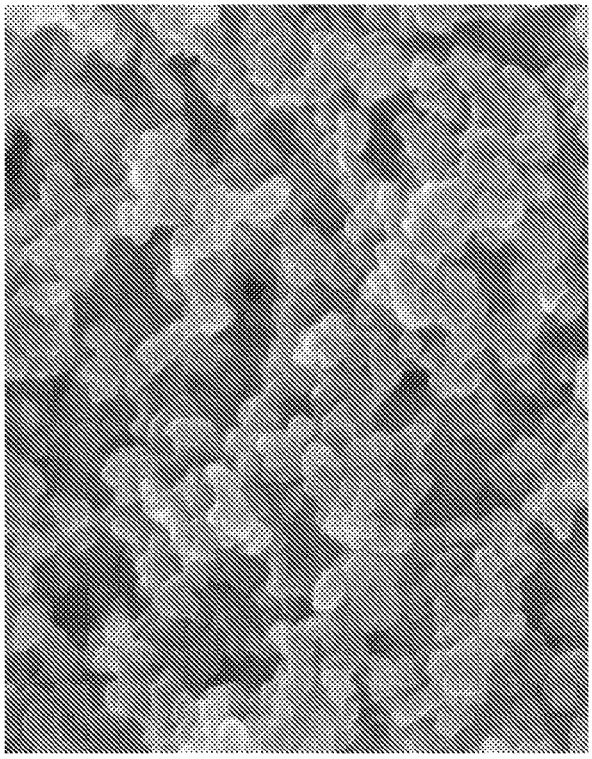
FIG. 15 shows a SEM micrograph of porous material suitable for the device of the invention.

In a following step, the material 156 is caused to phase separate. Phase separation is for instance initiated by inducing a chemical reaction such as thermal or photo-polymerization. After phase separation one phase is removed (for instance by extraction) so that a porous structure 114 remains (FIG. 6C). The pore size of the porous material 114 can be varied in a broad range by the manufacturing conditions (concentrations, temperature, solvents, etc.). FIGS. 15 and 16 show typical examples of porous microstructures, i.e. UV-cured acrylate and thermally cured epoxy, respectively. The materials shown in FIGS. 15 and 16 are suitable for the pertinent applications.

After the porous phase is dried, the capture probes 116 can be applied (FIG. 6D) if they are needed within the microfluidic device. The spots with immobilized capture substances are for example printed on the porous material. Applying the spots 116 involves for instance ink-jet, transfer and/or contact printing. Alternatively, the porous material is soaked in a solution comprising the capture substances so that the porous material absorbs the solution with capture substances, after which excessive solution is removed from non porous parts of the substrate. After application, appropriate post processing may be applied to render stable and reactive capture probes 116 that are distributed in the open pore structure of the porous material 114.

The second substrate can either comprise no recesses, empty recesses, or may be processed in substantially the same way as the first substrate to provide recesses having porous material with or without capture probe spots provided as described for the first recesses. Different spots can be conveniently provided using ink jet printing. Having first and second recesses in different substrates is advantageous when the porous material and or capture probe material needs to be different for the first and second recesses. Application processes then will not interfere as the first and second substrate may be independently processed.

According to choice, reflecting layers may be applied to certain parts of the substrates such as for example the walls of a recess. This may be done with an appropriate technique for depositing a thin metal (Al, Au, Ag, Cu, and others) such as electroplating, evaporation printing etc. Appropriate patterning techniques as known in the art can be employed. Alternatively, or additionally mirroring layers can be created by depositing layers on the substrate that have refractive indices that differ enough to perform total internal reflection. Absorbing layers may also be deposited using known techniques in the art.

The first substrate and the second substrate can be assembled to form the closed microfluidic system shown in for instance FIG. 2 or 3. The substrates can be glued or clamped together, depending on the mechanical properties of the substrates, the overall design and other requirements.

As described, the substrates of the device of the present invention can be fabricated by replication or molding techniques using a master/mold technology. Fabrication is commenced by lithographic exposure and development of a resist on a glass or silicon substrate. The developed resist on the substrate is transferred into a mold material, such as Ni, by electroplating.

In a subsequent step, the structure is replicated into a polymer by injection molding or embossing. The fabrication technique is substantially similar to the technology which is used for producing optical storage media, such as a CD.

Figures 7, 8, 9:
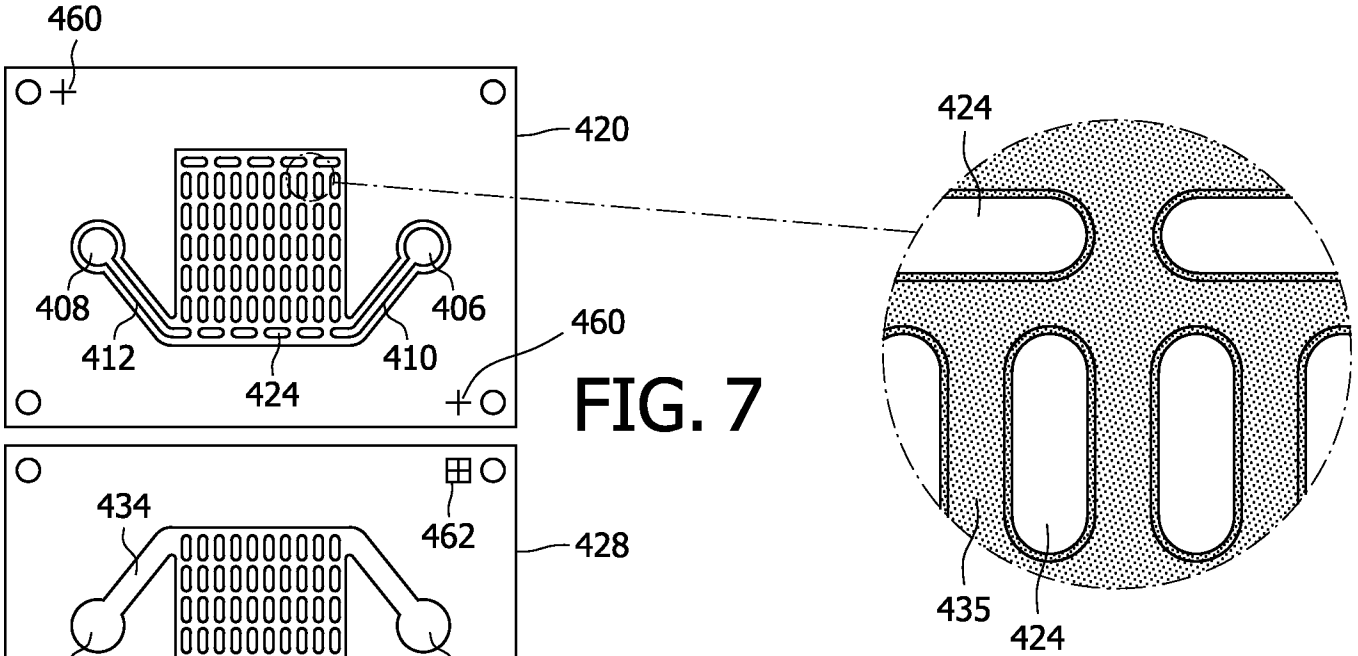
FIG. 7 shows a plan view of a mask for fabricating the first substrate.
FIG. 8 shows a plan view of a mask for fabricating the second substrate.
FIG. 9 shows a detail of the mask of FIG. 7.

FIGS. 7 and 8 show mask designs 420, 428 for fabricating the first substrate and the second substrate respectively. FIG. 9 shows a detail of the microstructure of FIG. 7

The parts 434, 435 of the mask are intended for forming elevated areas of the respective substrate, the parts 424, 430 are intended for forming recesses. Porous material structures are subsequently arranged within the recesses. Parts 410, 412 form the inlet and outlet channel parts 410, 412, and parts 406, 408 form the inlet and outlet 406, 408.

The structure is for instance fabricated using photolithography with SU-8 resist and using the mask of FIGS. 7 and 8. The masks of FIGS. 7 and 8 could be a low-cost printed foil mask.

The first and second masks and/or substrates include alignment markers 460, 462 to allow correct alignment of the first substrate onto the second substrate. Other, different substrate designs can be realized with the above described technique. The number and size of the (biological) spots can be varied in a broad range, within the limits of photolithography.

The sample fluid flow can be optimized by adapting the geometry of the recesses and the micro-channel. For instance, decreasing the channel height will increase the flow resistance.

Figure 10:
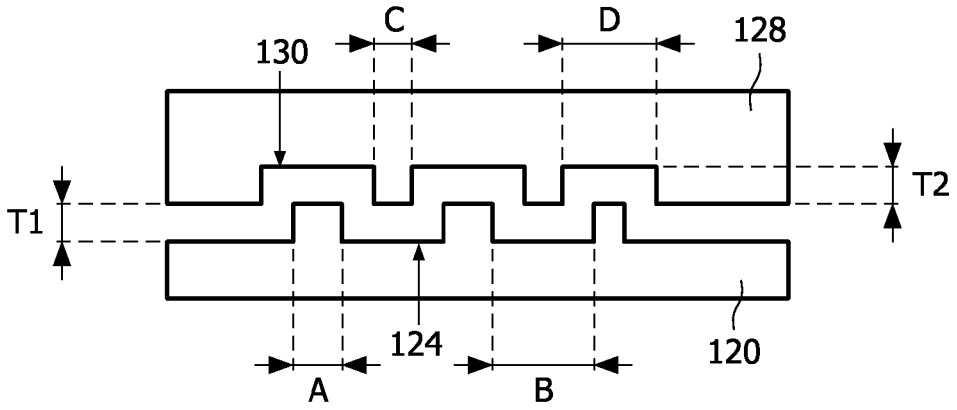
FIG. 10 shows a sectional side view of the device of the invention.
Figure 11:
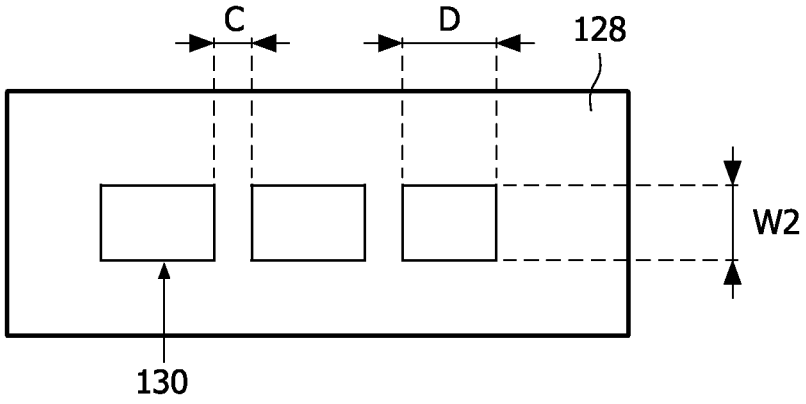
FIG. 11 shows a sectional plan view of the second substrate.
Figure 12:
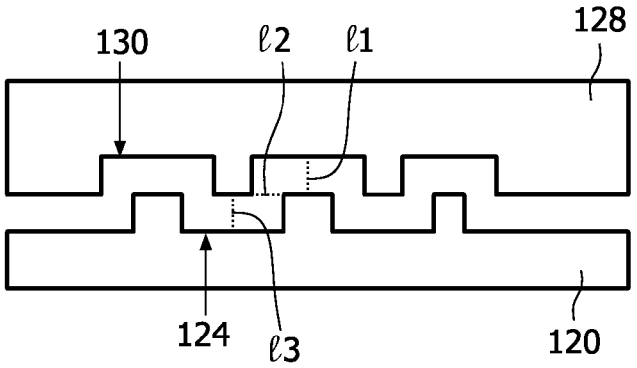
FIG. 12 shows a sectional side view of the device of the invention.

FIGS. 10-12 provide examples regarding the dimensions of the recesses and their ratios.

A and C indicate the length of the walls or stamps. B and D indicate the length of the first and second recesses respectively. The ratio A:B (FIG. 10) is for instance between 1:2 and 1:5. More preferably, the ratio A:B is between 1:2.5 and 1:4. Most preferably the ratio A:B is about 1:3. The ratios C:D, C:B and A:D may be within the same ranges. Herein, A faces D, and C faces B. Note that a 1:1 ratio would not work.

In a practical embodiment, A and/or C is for instance between 10 μm and 500 μam, and more preferably between 30 μm and 200 μm. B and/or D is for instance between 10 μm and 500 μm, and more preferably between 30 μm and 200 μm.

T1 and T2 indicate the depth or height of the first and second recesses respectively. The ratio T1:T2 (FIG. 10) is preferably between 1:3 and 3:1, more preferably between 1:2 and 2:1 and most preferably about 1:1.

T1 and or T2 are between 10 μm and 1000 μm, preferably between 50 μm and 200 μm.

W1 and or W2 are between 30 μm and 1000 μm, preferably between 100 μm and 500 μm.

In an embodiment, the height of the recesses forming the channel is in the range of 20-200 μm. The recesses are for instance about 250 μm wide (width W2 of the second recesses, shown in FIG. 11) and about 450 μm long. In another embodiment, the recesses are substantially rectangular for improving the sample fluid flow.

Figure 13:
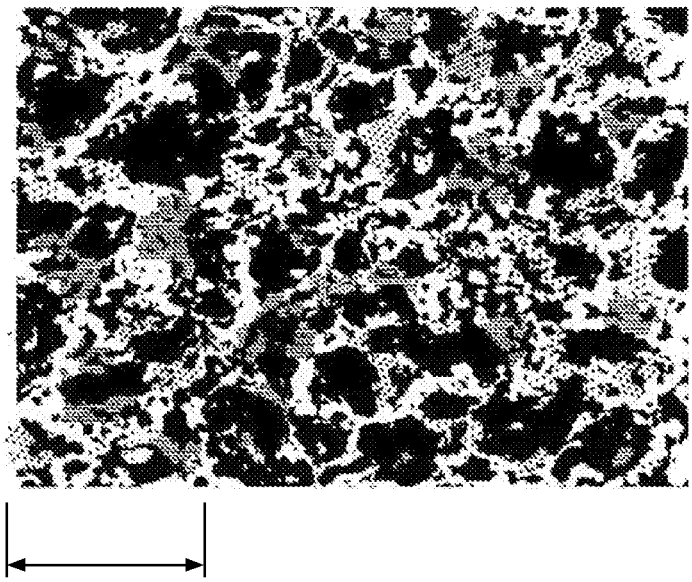
FIG. 13 shows a schematic depiction of porous material suitable for the device of the invention.

FIG. 13 shows several dotted lines 11, 12 and 13 across the channel. In a preferred embodiment, the cross section of the channel (i.e. the cross sectional area F=T*W, assuming that the channel has a rectangular cross section) are substantially identical at the positions indicated by the lines 11, 12 and 13. I.e., the difference of the channel cross section is less than a factor 2. In another embodiment, also the difference of the effective channel cross section area, which takes the porosity into account (as factor), is less than a factor 2.

In an improved embodiment, the first and the second substrate can be shifted with respect to each other in the planar direction. Planar direction is indicated by the x-axis and y-axis, wherein x is the length direction of the channel, and y the width direction. By doing so, the (first) channel can be interrupted, for instance by shifting in x-axis direction until A comes on top of C and B on top of D (FIG. 10). Subsequently, the substrate may be shifted in the y-direction, for opening other (second) channels or contacts to second channels could be opened. The one or more other channel could extend parallel to the above described first channel, or may extend for instance in y-direction.

Shifting of the substrates enables for instance faster washing or cleaning steps. I.e., the substrates can be shifted after the sample fluid has completely passed the first channel. Shifting the substrates could also enable the removal of air/gas bubbles in the first channel.

Figure 14:
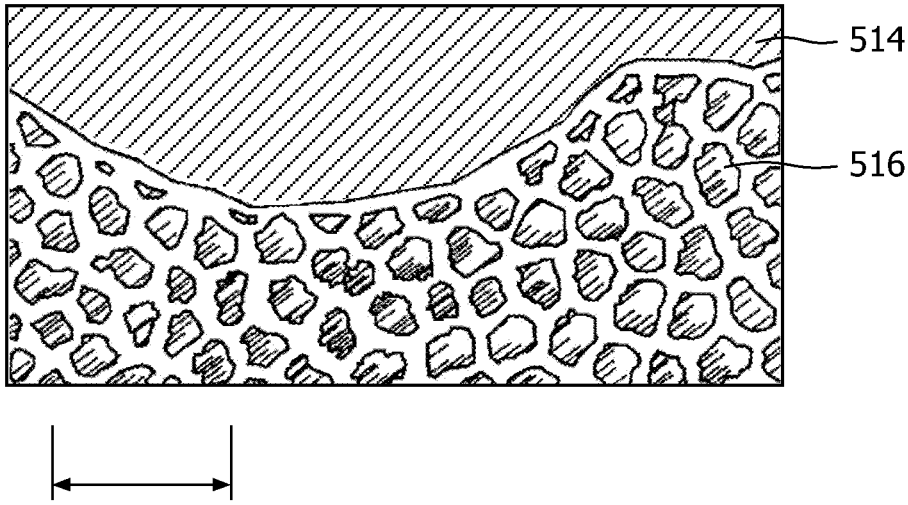
FIG. 14 shows a schematic depiction of porous material suitable for the device of the invention.

FIGS. 13 and 14 show schematically represented SEM pictures of membrane types. FIGS. 15 and 16 show scanning electron microscope (SEM) pictures of different membrane types.

FIG. 13 shows an isotropic Nylon membrane.

FIG. 14 shows anisotropic etched alumina 514, having pores 516 forming elongated channels having an average diameter in the order of one micrometer of smaller.

FIG. 15 shows a SEM micrograph of a porous membrane made by photo-polymerization induced phase separation.

FIG. 16 shows a SEM picture of a porous epoxy network as obtained by thermal curing of a mixture of an epoxy resin and PMMA. The PMMA phase is removed after reaction-induced phase separation.

The pores of the materials shown in FIGS. 13, 15 and 16 have a random structure. Alternatively, the porous material within the device according to the invention may comprise regular pore structure as are known in the field of chemical catalysis.

The microfluidic device may be part of a sensing device or analytic device. It my be permanently fixed in such a device such that it forms an integral part of the sensing device. Alternatively it may be removable/insertable in a sensing device. In the latter case the microfluidic device may be a disposable device to be used in a more complicated and/or cheap sensing unit.

Figure 17:
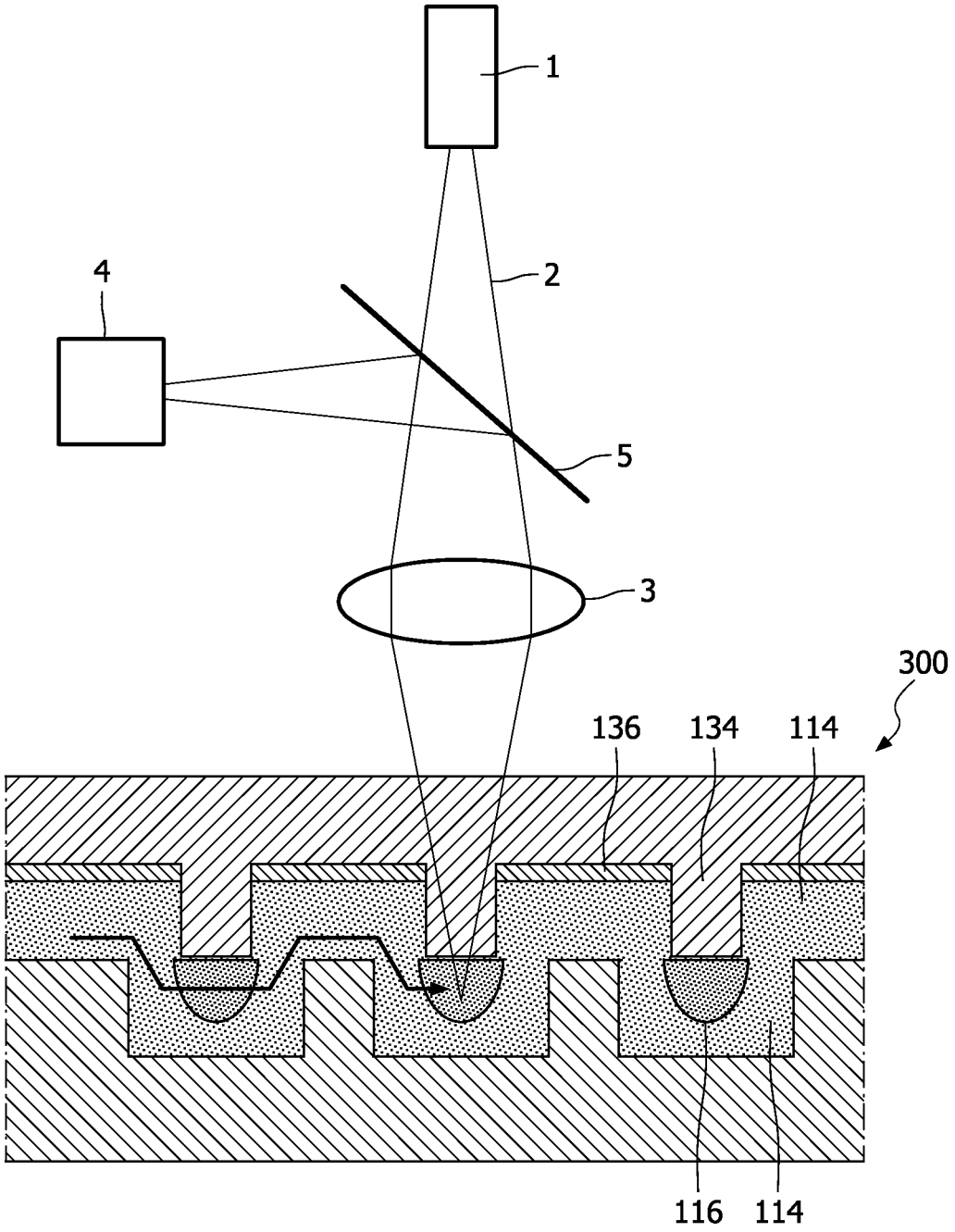
FIG. 17 shows a schematic sectional view of a sensor device of the invention.

An example of a sensor device is shown in FIG. 17. In an embodiment it may comprise a microfluidic device 300 as shown in FIG. 3 or FIG. 4, which will not be further explained here. The sensor device further comprises a radiation source 1 for providing input radiation 2 to one or more spots 116 through a refractive or focusing element 3 such as a lens. The output radiation irradiated by the spot if capturing of target species takes place is detected through the element 3 and sent to a detector 4 through a beam splitter 5 (in this case a dichroic mirror as the input radiation has a different wavelength region than the output radiation). The device may be equipped with all sorts of optical elements as known to those skilled in the art.

Although not drawn, a micro fluidic device could be used that allows detection more dense multiplexing. In that case the microfluidic device of FIG. 3 may for example be used. It has capturing spots in the porous material of the first and second recesses. The spots may be measured as described hereinbefore. In an advantageous embodiment the spots of the first recesses may be measured from a first direction and the spots of the second recesses may be measured from a second direction which is opposite to the first direction. The first direction may be the side of the first substrate. However, alternatively and advantageously the first direction may also be the side of the second substrate. This allows a setup of for example in the FIG. 17, wherein signal guiding walls and/or orientation of walls are provided to the parts, 135 like they are to parts 138 in FIG. 4. An efficient signal separation and reduction of crosstalk between signals stemming from neighboring, closely spaces spots (first and second recesses is then achieved. This increases the amount of spots per area on a microfluidic device and allows further miniaturization of the microfluidic device and/or the sensor or detector device.

The device of the invention may be used for multiple purposes depending on the analysis method to be performed. Thus it may be used as a filter by pumping a particular sample fluid through the channel. Alternatively, or in addition, the device may exhibit a target substance capturing capability as described hereinbefore and thus perform target specific filtering. In addition, or alternatively, the device may have a sensing function and form part of a detection device.

The device of the present invention is for instance applicable for detecting the presence of a protein in a biological sample. Also, the device could be used for selective capturing and/or release of biomolecules, such as protein, hormones, peptides, and/or single and double stranded oligonucleotides.

One or more reagents could be arranged in or on the porous material in any of the first or second recesses. A reagent could for instance dissolve in the sample fluid. The dissolved reagent may for instance enhance, support, or induce a particular reaction, or function as a catalyst. The biological assay procedure, a user will pump for instance a buffer solution or air through the channel 104 before or after the sample fluid to achieve a more accurate measurement.

The above-mentioned embodiments illustrate rather than limit the invention, and at that those skilled in the art will be able to design many alternative embodiments without departing from the scope of the appended claims. In the claims, any reference signs placed between parentheses shall not be construed as limiting the claim. The word "comprising" does not exclude the presence of elements or steps other than those listed in a claim. The word "a" or "an" preceding an element does not exclude the presence of a plurality of such elements. In the device claim enumerating several means, several of these means may be embodied by one and the same item of hardware. The mere fact that certain measures are recited in mutually different dependent.

The invention claimed is:

1. A microfluidic device, comprising:

a first substrate having a first surface;

a second substrate having a second surface, wherein the second surface contacts the first surface therewith defining an interface between the first and second substrates;

a set of recesses, consisting of a plurality of first recesses and a plurality of second recesses, provided at the interface;

a first porous material disposed in at least one recess among the set of recesses; and a first capture substance for binding a target substance, the first capture substance being arranged in or on the first porous material disposed in the at least one recess among the set of recesses, wherein the first recesses and second recesses form a channel meandering in a plane at right angles to the interface, and wherein the first recesses are arranged in the first surface and the second recesses are arranged in the second surface.

2. The microfluidic device of claim 1, further comprising a second porous material different from the first porous material, wherein the second porous material is disposed in at least another recess among the set of recesses.

3. The microfluidic device of claim 1, wherein the at least one recess in which the first porous material is disposed includes a corner, and wherein the first porous material abuts the corner.

4. The microfluidic device of claim 1, wherein the first porous material is disposed in at least one of the first recesses and in at least one of the second recesses, and wherein the first porous material disposed in the at least one of the first recesses contacts the second surface, and/or wherein the first porous material disposed in the at least one of the second recesses contacts the first surface.

5. The microfluidic device of claim 1, wherein the first capture substance is disposed in at least one of the first recesses and in at least one of the second recesses, and wherein the first capture substance disposed in the at least one of the first recesses contacts the second surface, and/or wherein the first capture substance disposed in the at least one of the second recesses contacts the first surface.

6. The microfluidic device of claim 1, wherein the porous material comprises a material which swells in contact with a sample fluid.

7. The microfluidic device of claim 1, further comprising walls disposed at the interface of the first substrate and the second substrate for guiding a first measuring signal of the first capture substance in a first direction, and/or for guiding a second measuring signal of a second capture substance in a second direction.

8. The microfluidic device of claim 7, wherein the second direction is substantially opposite to the first direction.

9. The microfluidic device of claim 1, wherein at least one recess among the set of recesses has tapered walls.

10. The microfluidic device of claim 1, wherein a bottom of at least one recess among the set of recesses is provided with an absorbing or reflecting layer.

11. The microfluidic device of claim 1, wherein side walls of at least one recess among the set of recesses is provided with a reflecting layer.

12. The microfluidic device of claim 1, wherein the first porous material comprises at least one reagent for dissolving in a sample fluid.

13. The microfluidic device of claim 1, wherein first porous material is disposed in all of the plurality of first recesses.

14. A sensor device, comprising:

a microfluidic device, comprising:

a first substrate having a first surface;

a second substrate having a second surface, wherein the second surface contacts the first surface therewith defining an interface between the first and second substrates;

a set of recesses, consisting of first recesses and second recesses, provided at the interface; and a first porous material disposed in at least one recess among the set of recesses, wherein the first recesses and second recesses form a channel meandering in a plane at right angles to the interface, and wherein the first recesses are disposed in the first surface of the first substrate and the second recesses are disposed in the second surface of the second substrate; and a detector configured to measure a response signal generated within the microfluidic device.

15. A method of manufacturing a microfluidic device, the method comprising:

providing a set of recesses, consisting of a plurality of first recesses within a first surface of a first substrate and a plurality of second recesses within a second surface of a second substrate;

providing a first porous material in at least one recess among the set of recesses; and contacting the first surface with the second surface therewith defining an interface between the first and second substrates, so that the first recesses and the second recesses form a channel meandering in a plane at right angles to the interface, wherein providing the first porous material in at least one recess among the set of recesses comprises providing the first porous material in all of the plurality of first recesses and providing the first porous material in all of the plurality of second recesses.

* * * * *